US005368709A

United States Patent [19]

Utklev

[11] Patent Number: 5,368,709

[45] Date of Patent: Nov. 29, 1994

[54] METHOD AND APPARATUS FOR CONTROLLING THE RELATIVE HUMIDITY IN CONCRETE AND MASONRY STRUCTURES

[75] Inventor: Kjell Utklev, Moss, Norway

[73] Assignee: Elcraft A/S, Dilling, Norway

[21] Appl. No.: 768,609

[22] PCT Filed: Mar. 12, 1990

[86] PCT No.: PCT/NO90/00049

§ 371 Date: Sep. 26, 1991

§ 102(e) Date: Sep. 26, 1991

[87] PCT Pub. No.: WO90/10767

PCT Pub. Date: Sep. 20, 1990

[30] Foreign Application Priority Data

Mar. 10, 1989 [NO] Norway ..... 891034

[51] Int. Cl.[5] ..... B01D 13/02

[52] U.S. Cl. ..... 204/182.2; 204/130; 204/299 R

[58] Field of Search ..... 204/182.2, 299 R, 130

[56] References Cited

U.S. PATENT DOCUMENTS 4,600,486 7/1986 Oppitz ..... 204/182.2

5,015,351 5/1991 Miller ..... 204/182.2

*Primary Examiner*—John Niebling

*Assistant Examiner*—Kishor Mayekar

*Attorney, Agent, or Firm*—Merchant & Gould Smith, Edell, Welter & Schmidt

[57] ABSTRACT

In a method for eliminating humidity from concrete and masonry structures by means of electroosmosis, current pulses which are supplied in a determined pattern are used. The pulse voltage is limited to ±40 V. In order to generate the pulses and feed the electrodes a special electronic control device is used.

12 Claims, 12 Drawing Sheets

HYBRID MC411

Figure 1:
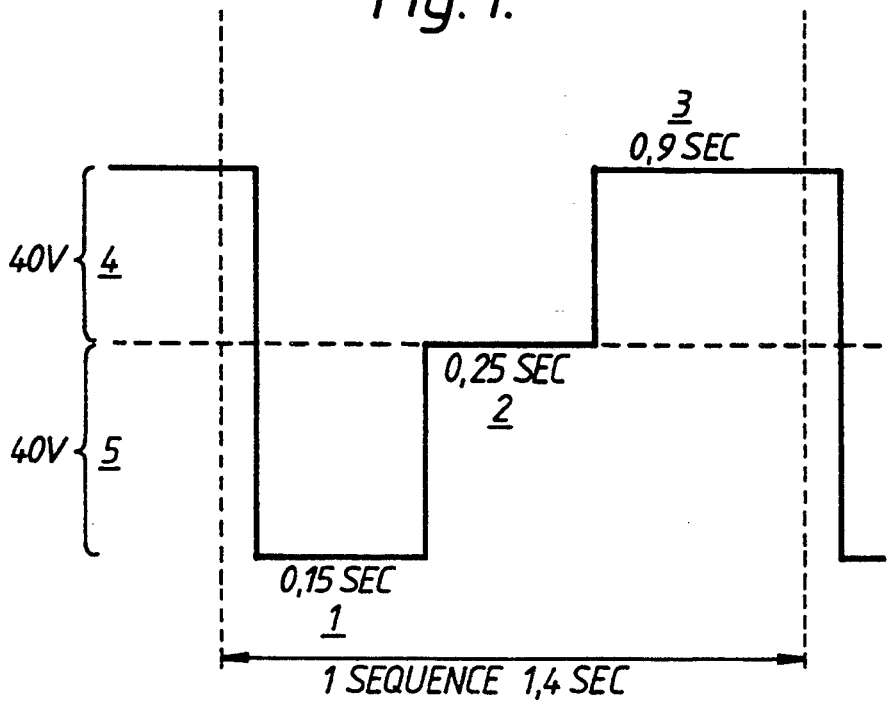

METHOD AND APPARATUS FOR CONTROLLING THE RELATIVE HUMIDITY IN CONCRETE AND MASONRY STRUCTURES

The invention relates to a method and means for controlling the relative humidity in concrete and masonry, including masonry wherein cement is used as a bonding agent. The structure may be reinforced or not, and the method may also be used in plaster, mortar in stone masonry and light concrete structures.

The object of the invention is a directional control of the migration path of the humidity, in or out of a structure by use of a DC current pulse in a determined sequence.

Thus it is desired to make a control of the relative humidity content in both small and large concrete structures, for instance to reduce the humidity from 100% to about 70% in order to maintain the most suitable conditions, also for a possible reinforcement and further to keep humidity away from the structure with a regard to fracturing by frost, the occurrence of fungi and wet rot, possibly high air humidity in rooms, so-called cellar odour, limit corrosion, slow down the carbonatization and vice versa.

By start-up of a device according to the invention the relative humidity will be high. By using a high voltage the dehumidification is accelerated. The relative current drawn and power are high. When 80% relative humidity is approached, the current drawn is reduced. The voltage will still provide a high power due to a reduced conductance. The process will nevertheless be relatively slower as the relative humidity is reduced. This is caused by the conductance of the concrete structure being reduced. A structure with a supposedly low relative humidity will maintain the achieved condition by the conductance increasing on renewed penetration of liquid.

The method is advantageously realized with a device which comprises a hybrid circuit which drives an attached power transistor stage, so that the latter is either wholly conductive or completely blocking. Also within the scope of the invention is a device wherein transistor stages are replaced by relays or thyristors. The device includes functions such as a monitoring system which informs of circuit breakage, short-circuits, current interruptions, blown fuses and normal operation.

The electronic device feeds the anodes (for instance reinforcement) or anodes provided in the structure with the particular pulse pattern of the invention and thereby creates an osmotic pressure due to said pulse pattern. This pressure drives humidity in the capillaries out of the concrete towards the externally provided ground cathode.

The improvement achieved comprises: increased power, a monitoring and alarm system, reduced drift when the temperature changes, reduced heat generation in the solid state power circuit, improved apparatus housing and power supply certified by the Authorities.

In order to optimize the device with regard to power consumption, the output stage is constructed as a bridged complementary stage, wherein saturation of transistors is made possible by predriver and driver stage having their own power supply, with compensation for voltage reduction in solid state circuitry in a push-pull complementary stage. This stage is bridged with a corresponding push-pull complementary stage.

The features characterizing the invention are as follows:

1. Due to safety reasons, a positive and negative pulse of 40 V is used.

2. Salts are driven out with the humidity, something which slows down the carbonatization process.

3. Anodes which are adapted to the pH values and the chemical conditions on the installation site are used.

4. Current and voltage is dependent on and self-regulated in dependence of the conductivity and the humidity of the concrete structure. The current drawn is limited by a predetermined boundary value.

5. The direction of the osmotic pressure is controlled.

According to the invention there may for instance be used DC current pulses with a positive pulse fed to the reinforcement of the structure or to an installed anode, the pulse having a controllable duration. Then a negative pulse is fed to the anode for about 1/6 of the duration of the positive pulse, followed by a interval with a duration between 0 and ⅕, 5 of the positive pulse. Usually a pulse sequence is applied in start-up phase, which usually takes about two weeks and a pulse sequence for maintenance applied for a duration of five times that period. An increased instantaneous power of 50 times the normal power may also be applied, this in order to handle larger concrete structures and to achieve a quick expulsion of humidity, lowering the relative humidity from 100% to 70%, so that carbonatization ceases in structures reinforced with iron bars. Preferably the system makes use of a hybrid circuit which drives an attached power transistor stage, so that the latter may be wholly conductive or completely blocking.

Figure 2:
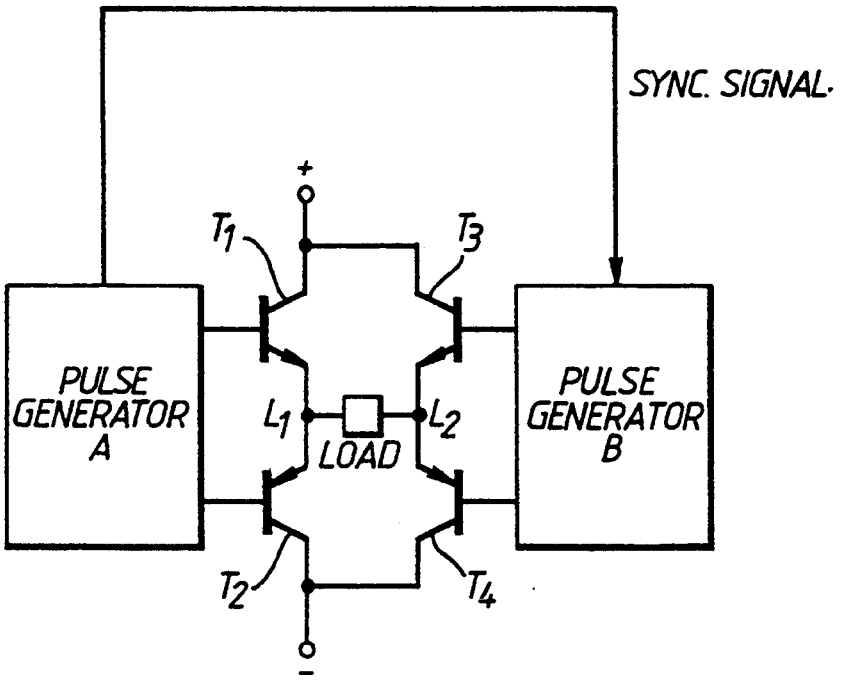
Figure 2A:
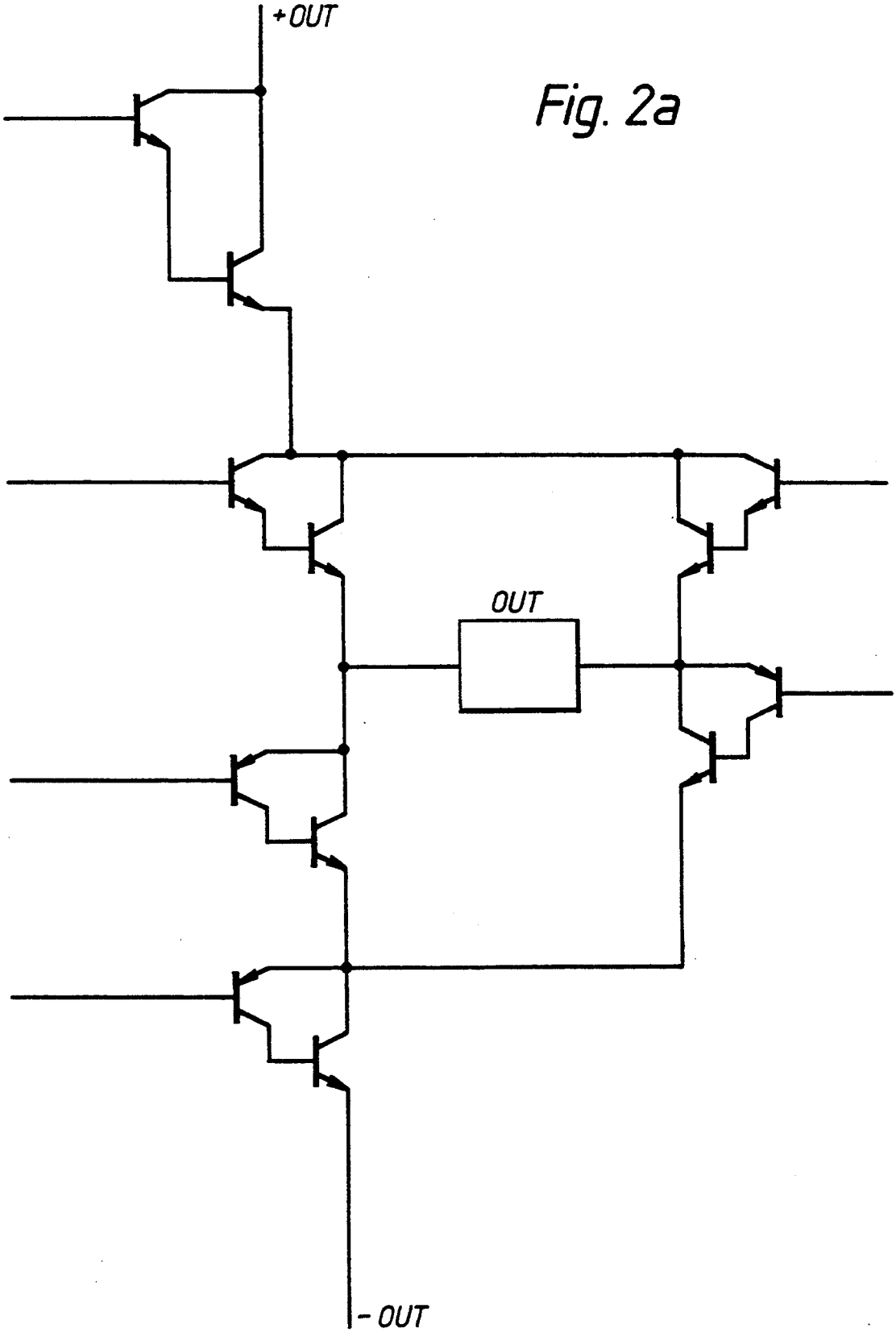
Figure 3:
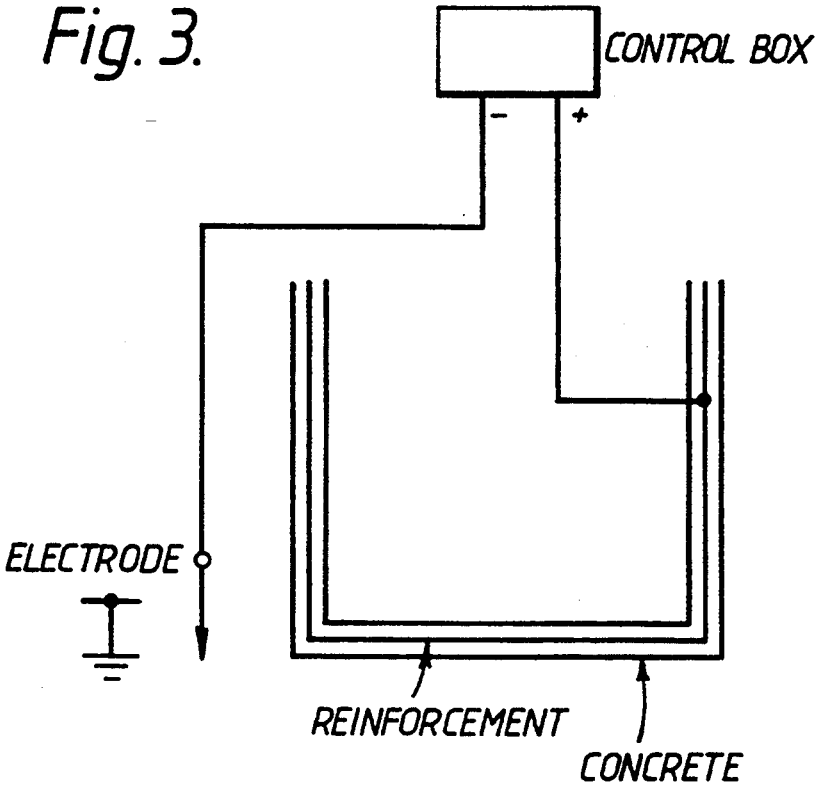
Figure 4:
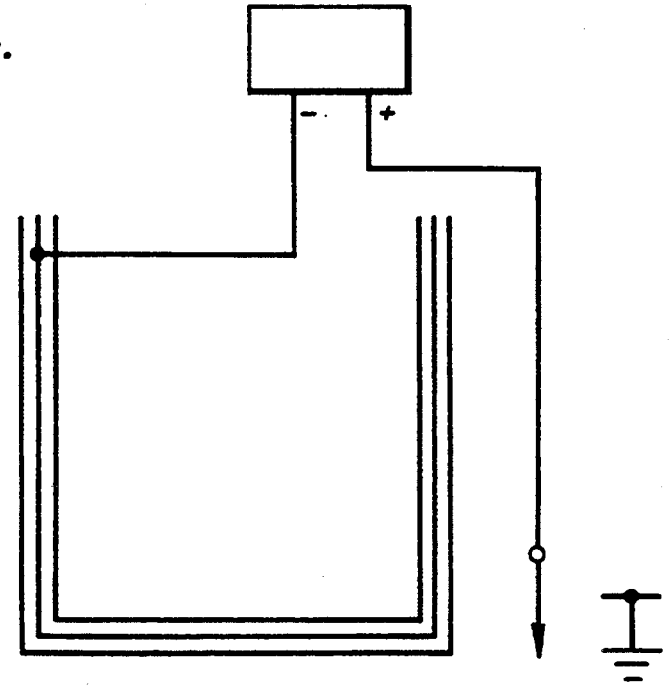
Figure 5:
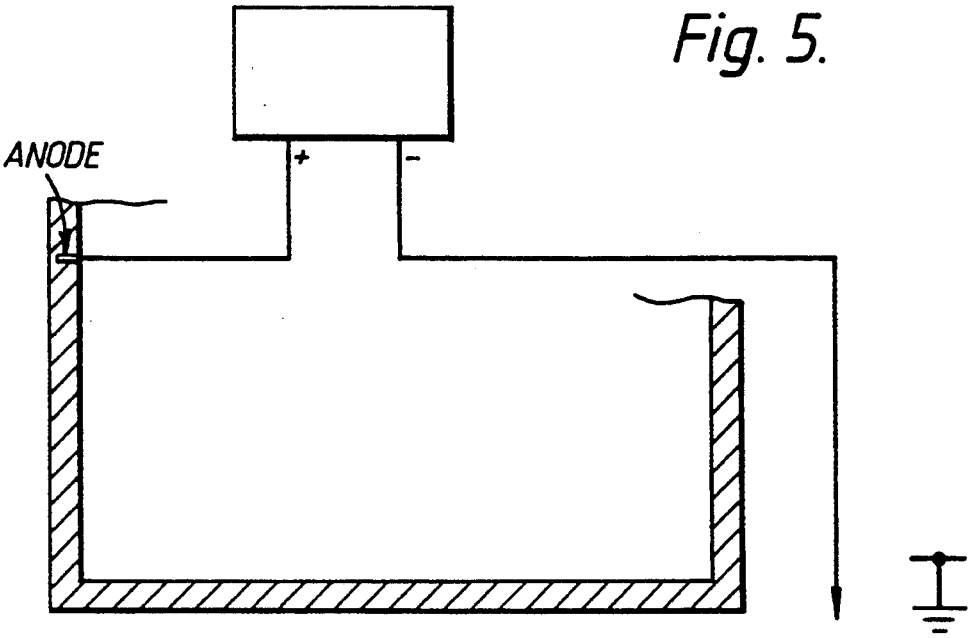
Figure 6:
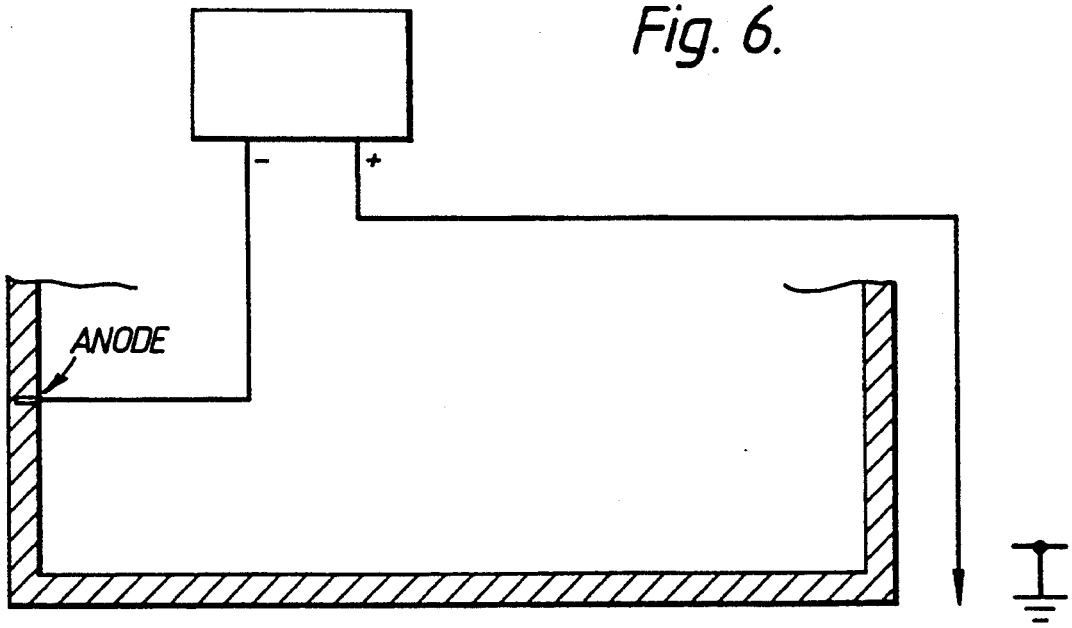
Figure 7:
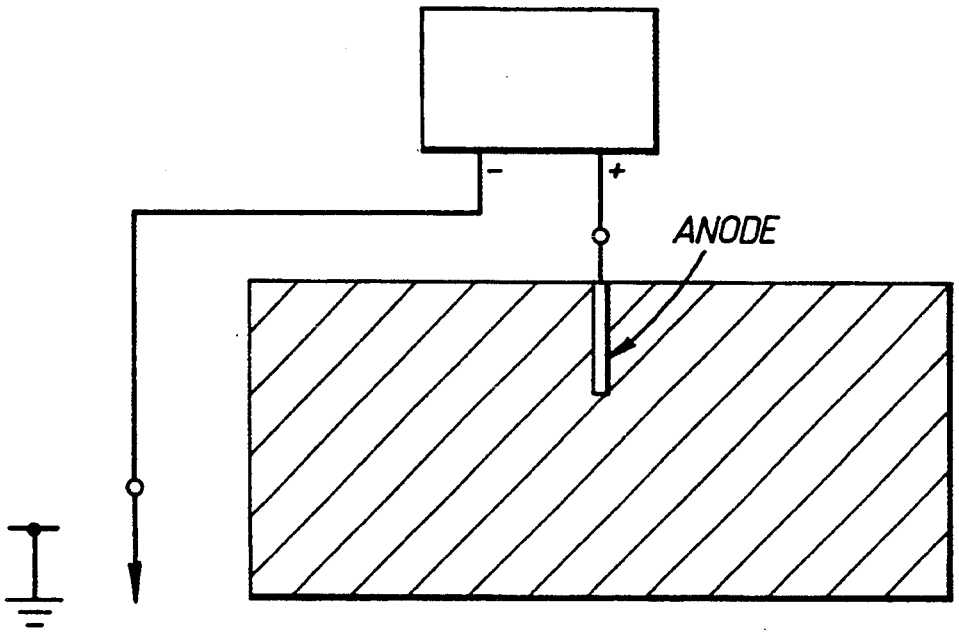
Figure 8:
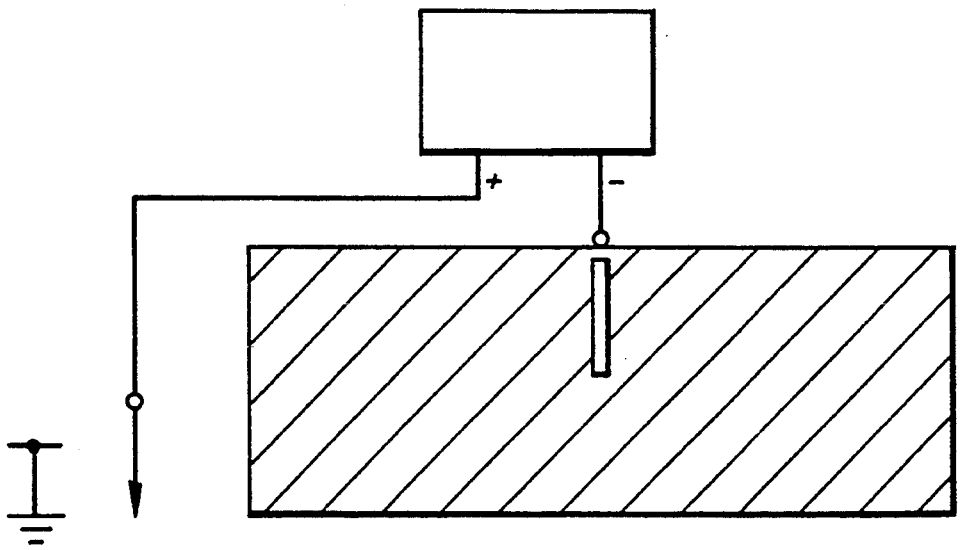
Figure 9:
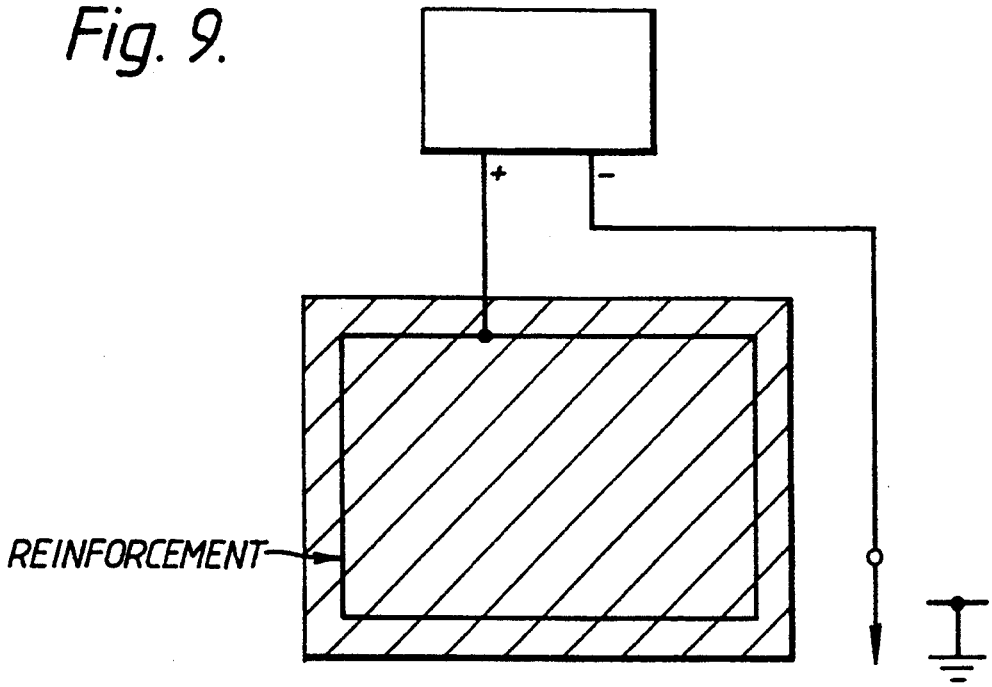
Figure 10:
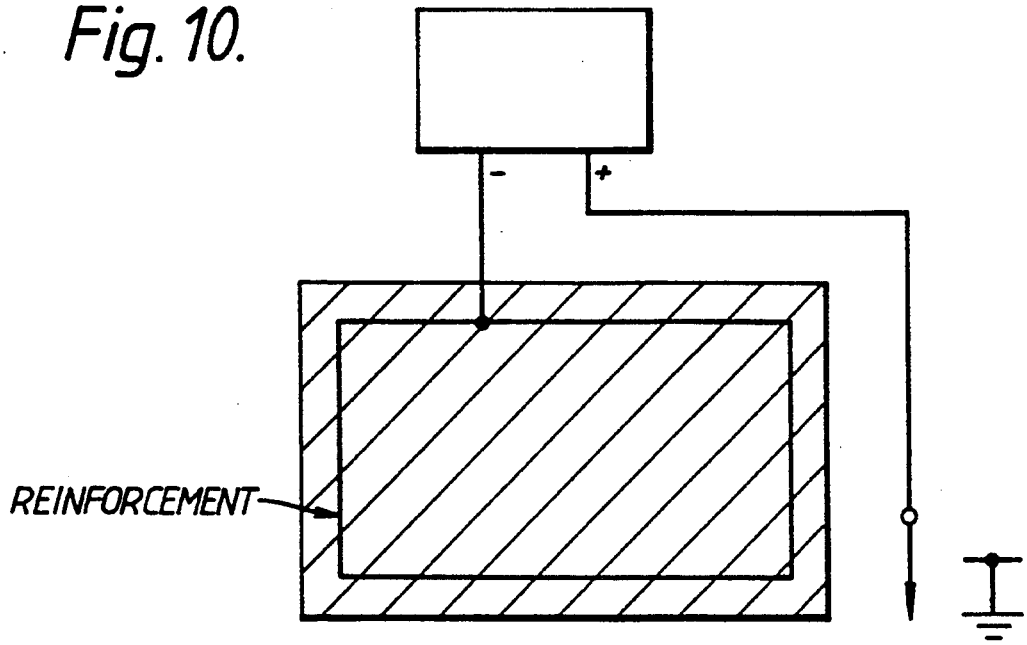
Figure 11A:
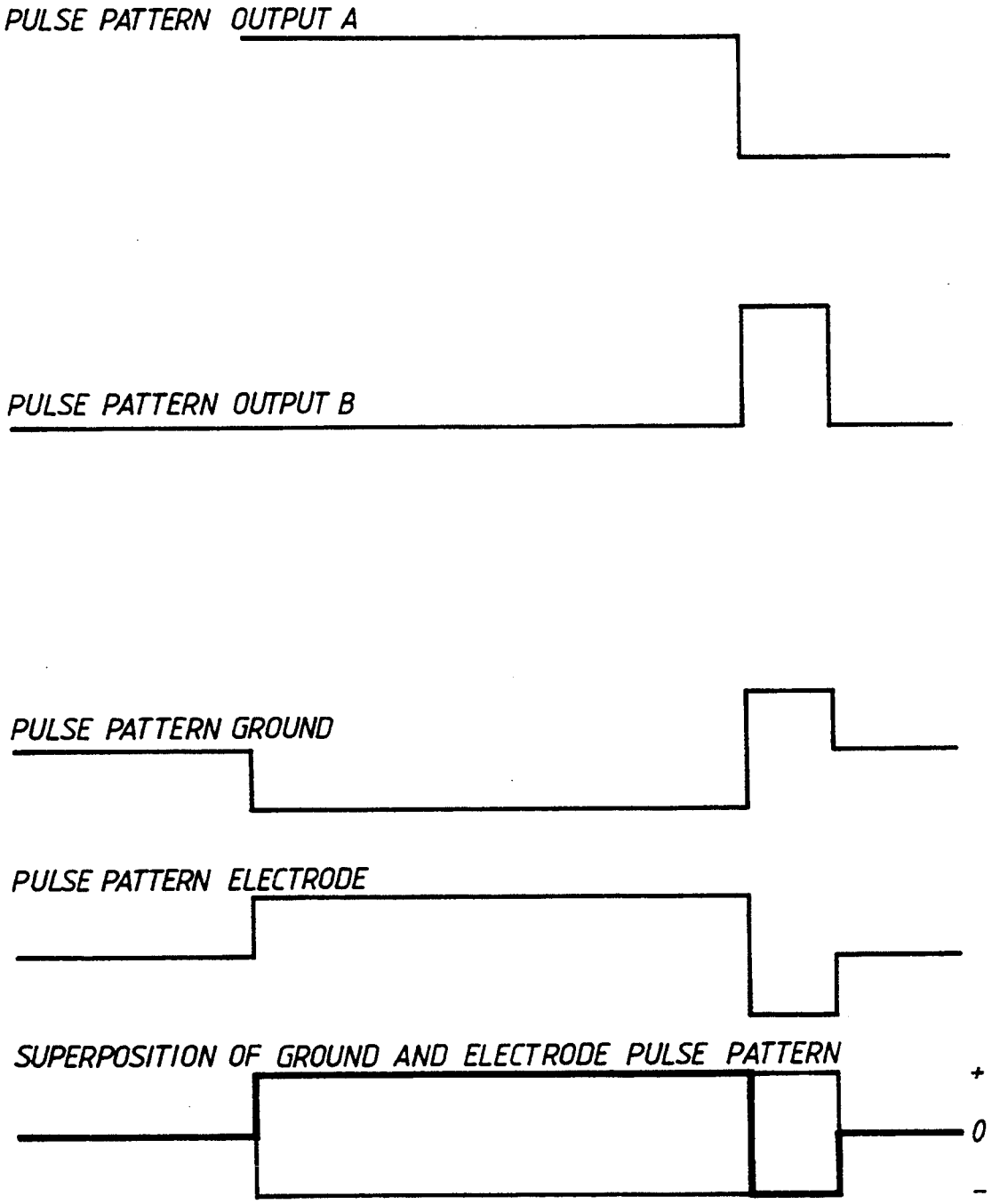
Figure 11B:
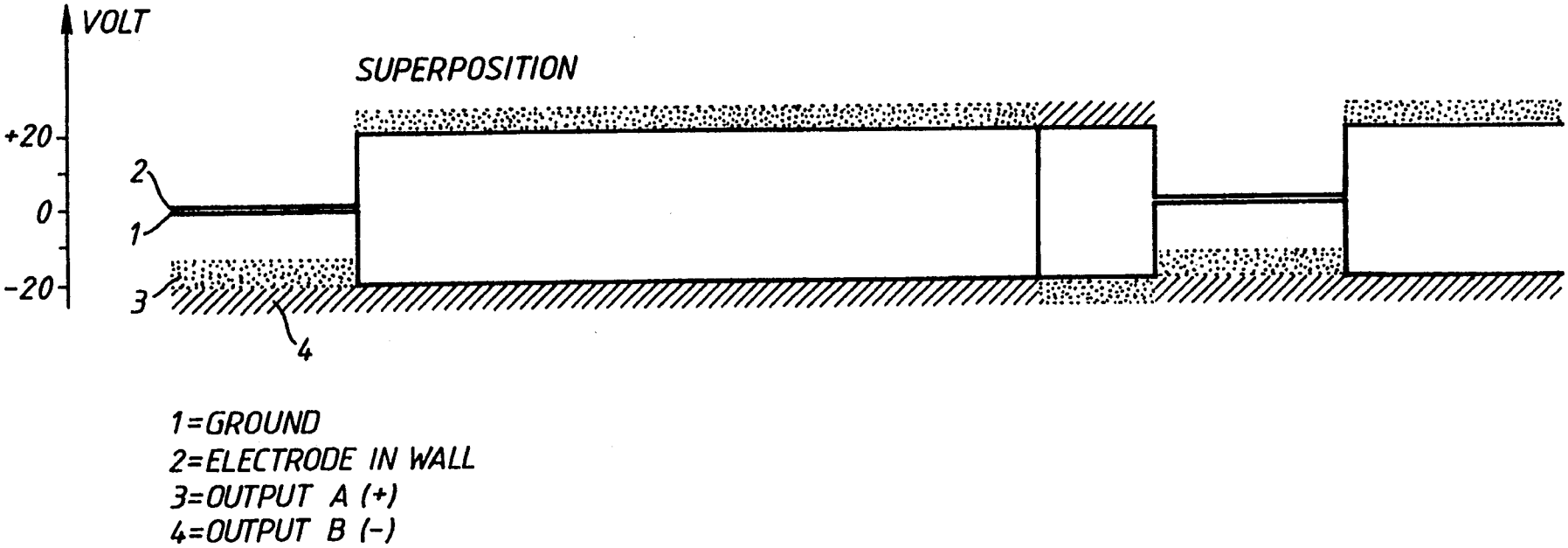
Figure 12:
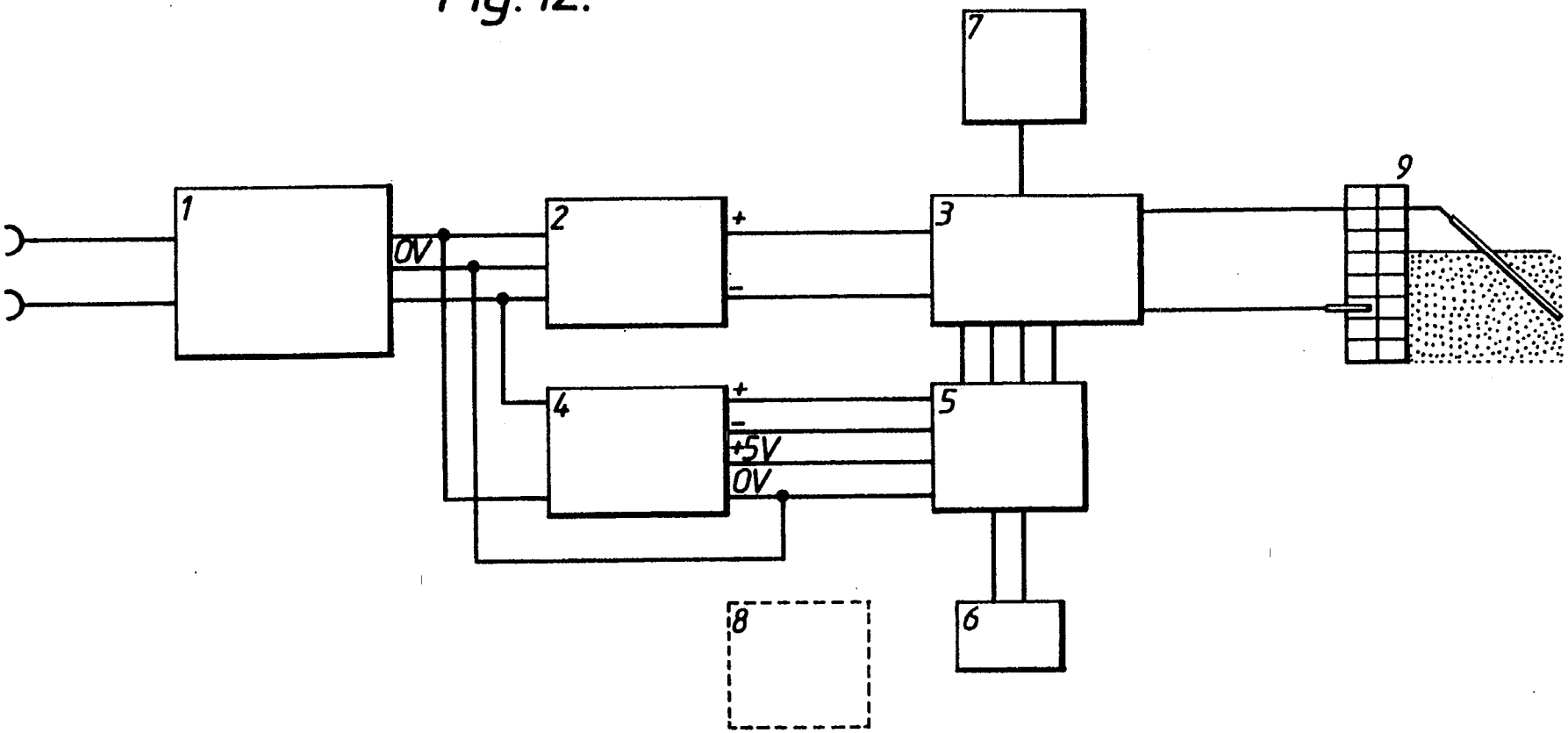
Figure 13:
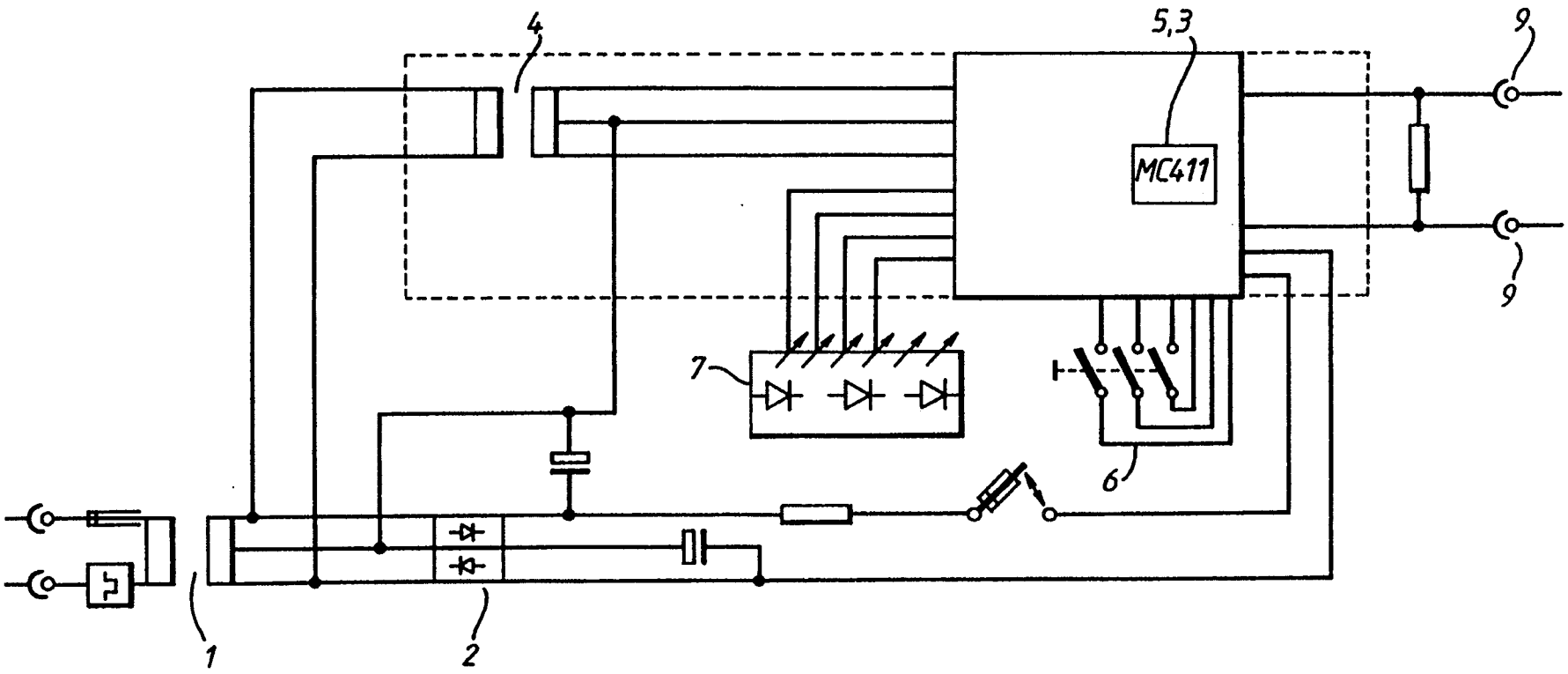
Figure 14:
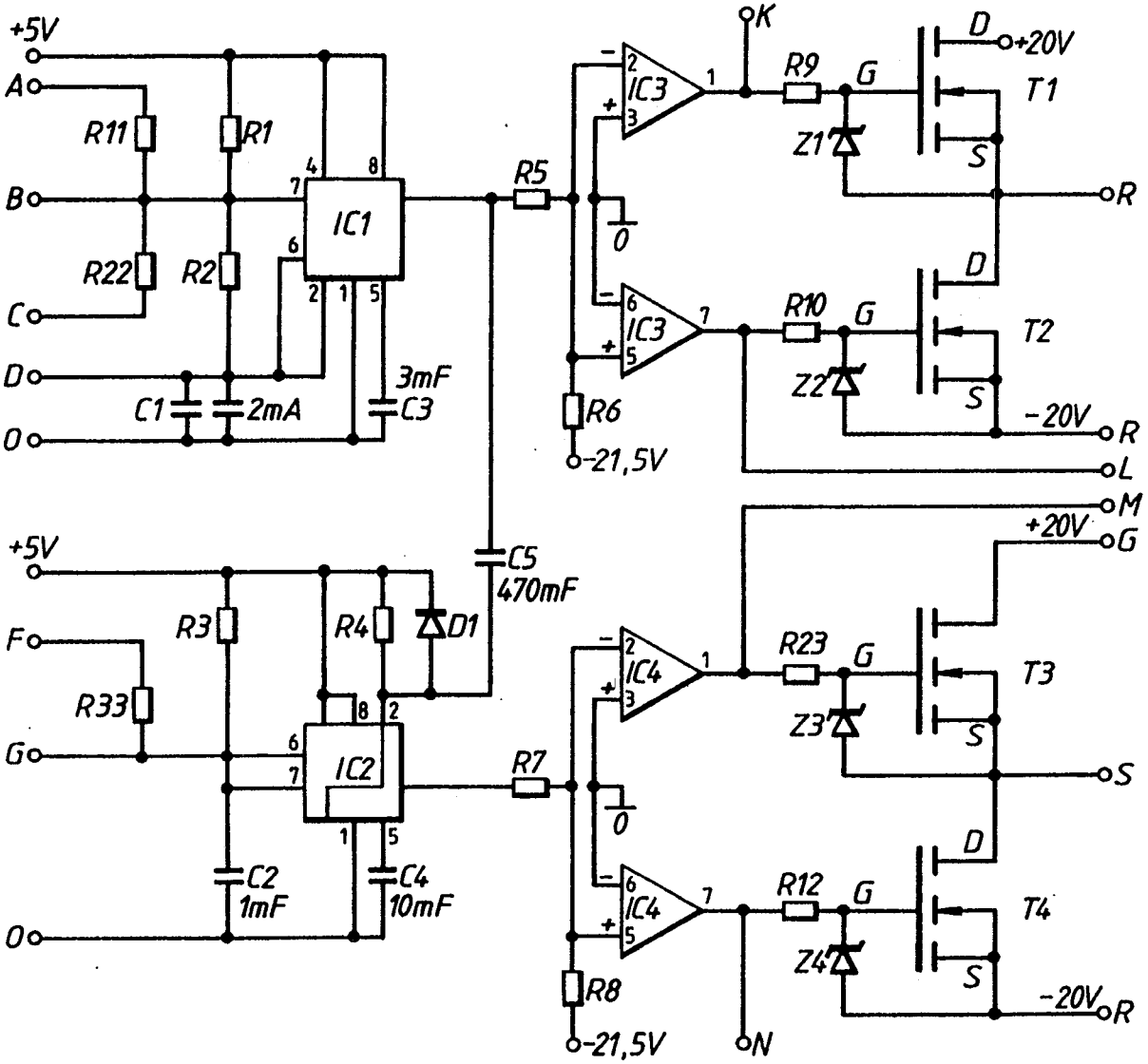
Figure 15:
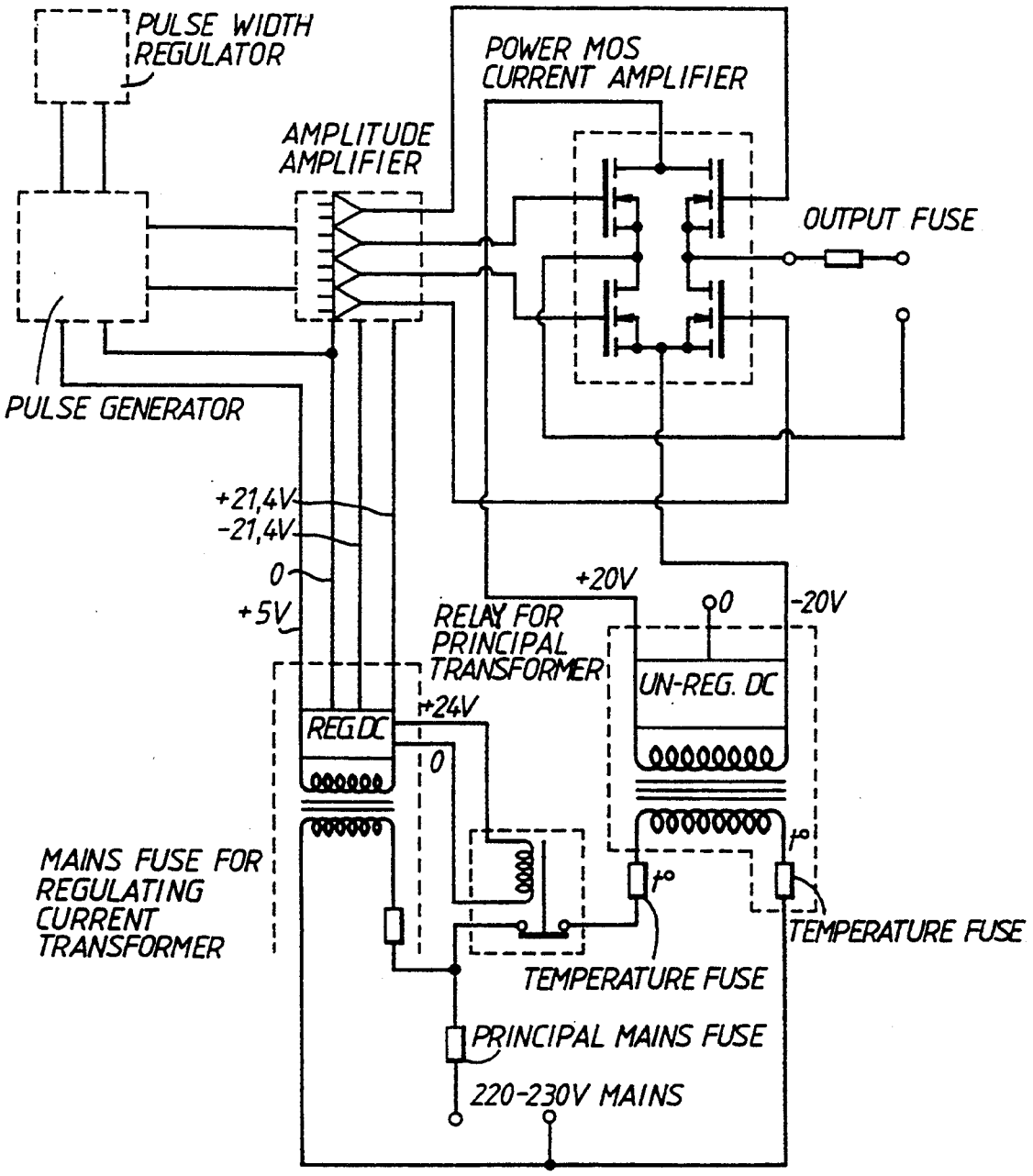

The invention is further illuminated by means of the appended drawings which partly show the pulse pattern used and their combinations (FIG. 1), partly circuitry according to the invention (FIG. 2) and partly examples of embodiments of the invention (FIGS. 3–10), as well as details of the pulse pattern (FIGS. 11*a*, 11*b*) and further details of the electronic device (FIGS. 12–15).

I claim:

1. A method for expulsion or control of humidity in a concrete or masonry structure, having a current source and one or more electrodes comprising at least one anode and cathode being provided in the concrete or masonry structure, the electrodes being a non-corrosive material, and connected in series or parallel with the current source, wherein an earth electrode is provided adjacent to or on the concrete or masonry structure, so that the electrode or electrodes comprise the anode and the earth electrode comprises the cathode in an electric circuit when they are connected to outputs of current source, wherein the anode and cathode are provided with a pulse voltage supplied by the current source, and wherein the pulse voltage is delivered sequentially as pulse sequences of a given pattern, comprising the steps of feeding the anode with a pulse sequence generated with a first negative pulse of a duration, followed by a neutral interval or a zero voltage interval of a changing duration being from greater than 0 to 2 times that of the duration of said first negative pulse, followed by a positive pulse, and simultaneously feeding the cathode with a corresponding pulse sequence, but of inverted polarity; whereby the humidity in the structure is controlled.

2. A method for expulsion or control of humidity in a concrete or masonry structure, having a current source and one or more electrodes comprising at least one anode and cathode being provided in the concrete or masonry structure, the electrodes being a non-corrosive material, and connected in series or parallel with the current source, wherein an earth electrode is provided adjacent to or on the concrete or masonry structure, so that the electrode or electrodes comprise the anode and the earth electrode comprises the cathode in an electric circuit when they are connected with outputs of the current source, wherein the anode and cathode are provided with a pulse voltage supplied by the current source, and wherein the pulse voltage is delivered sequentially as pulse sequences of a given pattern, comprising the steps of feeding the anode with a pulse sequence generated with a first negative pulse of a duration, followed by a neutral interval or a zero voltage interval of a changing duration being from greater than 0 to 2 times that of the duration of said first negative pulse, followed by a positive pulse, having a duration which is about six times that of the duration of the negative pulse, and simultaneously feeding the cathode with a corresponding pulse sequence, but of inverted polarity; whereby the humidity in the structure is controlled.

3. A method according to claim 2, wherein the duration of each said pulse sequence is regulated within a range of 1 to 20 seconds, so that a pulse frequency lies in a range of 0.05 to 1 Hz.

4. A method according to claim 3, wherein the pulse voltage delivered by the current source has an amplitude of maximum absolute value of 22 V.

5. A method according to claim 4, wherein the step of feeding the anode and cathode with pulses includes a first step of quickly reducing the relative in humidity by employing a pulse sequence frequency of 0.05 to 1 Hz, followed by a second step for maintenance of a permanently low humidity content, wherein a pulse sequence frequency of typically 0.1 to 0.2 times the pulse sequence frequency of the first phase is applied.

6. A method according to claim 5, wherein the step of feeding the anode and cathode with pulses further includes the step of applying an instantaneous power regulated by a factor of 50–100, depending on the following factors: structural material properties of the concrete or masonry structure, impedance of the cathode and the relative humidity initially of the concrete or masonry structure.

7. A method according to claim 6, wherein said current source supplies a maximum instantaneous power is about 2 kW.

8. A method according to claim 7 wherein corrosion resistant material is applied to the electrodes.

9. Apparatus for reducing relative humidity in a concrete or masonry structure comprising a controlled power supply, pulse voltage lines, control voltage lines and a neutral conductor, a pulse width modulator, at least one pulse generator, a complimentary push/pull amplifier stage, and first and second output electrodes, wherein said power supply is connected to said pulse width modulator, which in turn are connected to said at least one pulse generator, and thereafter to said amplifier stage, said amplifier stage being bridged for synchronous feeding said electrodes with a pulse sequence to said first electrode and corresponding pulse of inverted polarity to said second electrode, so that a potential between said electrodes is twice that of each electrodes ground potential.

10. Apparatus according to claim 9, wherein between an output of the push/pull amplifiers stage and the electrodes there are provided respective MOSFET output power amplifiers, for further amplification of power supplied to the electrodes.

11. Apparatus according to claim 10, wherein the pulse width modulators, pulse generators and amplifier stage are designed as a hybrid integrated circuit.

12. Apparatus according to claim 11, further comprising a display device adapted for indicating a selected pulse pattern as well as for indicating a voltage of the lines at the electrodes.

* * * * *